United States Patent [19]

Berniola Gil

[11] Patent Number: 4,852,302

[45] Date of Patent: Aug. 1, 1989

[54] SEAL FOR THE LOWER EDGE OF DOORS AND THE LIKE

[76] Inventor: Antonio Berniola Gil, Floridablanca, 124, 1°1ª 08011 *Barcelona, Spain*

[21] Appl. No.: 169,497

[22] Filed: Mar. 17, 1988

[30] Foreign Application Priority Data

Mar. 20, 1987 [ES] Spain ..... 8701399

[51] Int. Cl.[4] ..... E06B 7/16

[52] U.S. Cl. ..... 49/482; 49/303

[58] Field of Search ..... 49/482, 303, 316, 306–309

[56] References Cited

U.S. PATENT DOCUMENTS

| | | | |
|---|---|---|---|
| 419,949 | 1/1890 | Hibbert | 49/482 X |
| 1,677,067 | 7/1928 | Zimmerman et al. | 49/482 X |
| 4,170,846 | 10/1979 | Dument et al. | 49/303 |
| 4,479,330 | 10/1984 | Muller | 49/303 |

*Primary Examiner*—James R. Brittain

*Attorney, Agent, or Firm*—Brady, O'Boyle & Gates

[57] ABSTRACT

Two substantially equal length rails are connected juxtaposed with a longitudinal slide connection therebetween, with strips of soft sealing material on the lower surfaces to engage the floor and seal the opening beneath a door, whereby the length of the door seal rail can be adjusted for all widths of doors. A locking screw locks the rails in a desired adjusted length, and a pair of spring mechanism assemblies, one connected to each of the two rails, from which the rails depend on spring members, connect the rails adjacent the lower edge of a door or the like and maintain the strips of soft sealing material in engagement with the floor.

3 Claims, 1 Drawing Sheet

SEAL FOR THE LOWER EDGE OF DOORS AND THE LIKE

The object of this invention is to provide a new seal for the bottom edge of doors and similar things.

BACKGROUND OF THE INVENTION

Seals of the type comprised of rigid strips or laths to be fixed on the lower edge of doors and similar objects, to block the passage of air currents through the opening which remains between the floor and the lower edge of the door, are known to the market.

Seals for this purpose exist in different types, from those in which the edge has a band of soft material, to those in which part of them, the lower part, is equipped to lower and raise, as desires, such as in U.S. Pat. No. 4,479,330, in order that the lowered part be supported firmly against the surface of the floor when the door is closed.

This descending part is raised, when desired, just before opening the door.

However, all the seals of the types mentioned suffer from the same defect, which is that special methods are required to measure and to cut the rigid strip or lath, which is usually metallic. Special knowledge is necessary for the purpose, in order to adapt the said lath to a door, and therefore specialized installers are required to carry out the installation of the seal in the proper way.

SUMMARY OF THE INVENTION

With this invention one achieves the possibility of installation being made by any unspecialized person.

Another interesting advantage of the invention is the fact that it can be removed to adapt it to another door of different dimensions, which is impossible with a conventional seal, which once cut to the measure of the door's width, cannot be utilized for another door of greater width.

One can also note the advantage of storage for wholesalers and retailers of this new extendable automatic seal, since a single length is sufficient to supply the demand of the users of all sizes.

BRIEF DESCRIPTION OF THE DRAWINGS

In the interest of correct interpretation an example of practical execution of the new seal is described below, by way of non-limiting example, by reference to the accompanying drawings, in which.

DESCRIPTION OF THE PREFERRED EMBODIMENTS

Figure 1:
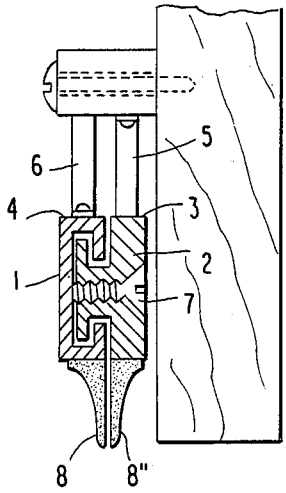
FIG. 1 is a fragmentary end elevational view of the free edge of a door and showing the door seal of the invention partly in cross-section taken along line A–B of FIG. 2.

The door seal of the invention consists of two essentially equal length rails 1 and 2, having end profiles or cross-sections that permit them to cooperatively slidingly engage each other, permitting the sliding union of the two rails so that the composite sliding rail may be adjusted in length for different door widths. As shown in FIG. 1, rail 1 may be C-shaped in cross-section, with the open edges of the C-shape slidingly engaged in grooves extending along the length of the upper surface 3 and the lower surface of rail 2, so that rails 1 and 2 are slidingly inserted into each other, and that the overall length of the assembled rails 1 and 2 can be adjusted to correspond to the width of doors of various width, as shown in FIGS. 2 and 3.

Figure 3:
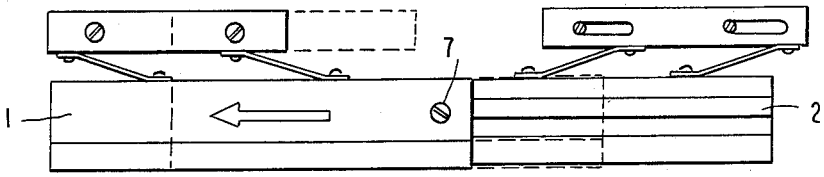
FIG. 3 is a front elevation view showing the adjustable length door seal in an extended position.

Spring mechanism assemblies 5 and 6 are respectively attached to the upper surfaces 3 and 4 of the rails 2 and 1, as more clearly shown in FIGS. 1 and 3. The spring mechanism assemblies 5 and 6 are connected symmetrically opposed and placed apart from each other, and each consists of a body portion adapted to be connected to the face of a door or the like, and spring means such as a pair of leaf springs connected at one end to the body portions, depending therefrom at an angle, and connected at the opposite end to the respective rails 2 or 1.

Figure 2:
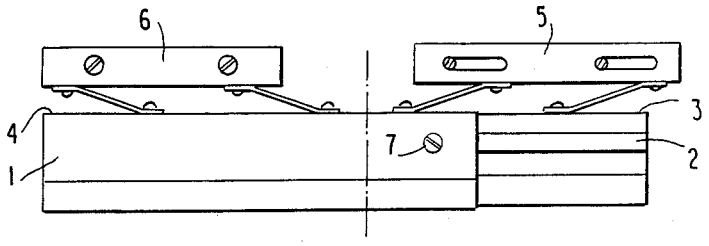
FIG. 2 is a front elevation view of the adjustable length door seal of the invention.

As shown in FIG. 3, when rail 1 is slid in the direction of the arrow, longitudinally in the grooves of rail 2 from the dotted line position, which represents the position shown in FIG. 2, to the full line position, the length of the door seal is increased to the width required to match the width of the door to which it is to be connected. The rails 1 and 2 are then locked in the desired length by means of screw 7 which extends through one of the rails and into locking engagement with the other of the rails.

Figure 4:
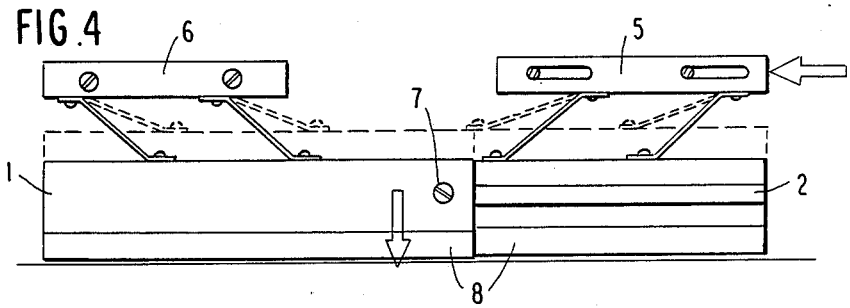
FIG. 4 is a front elevation view showing the door seal of FIG. 3 in an installed lower position on a door to engage the floor.

Each of the rails 1 and 2 has a strip of soft sealing material 8 and 8″ along the lower surfaces thereof, respectively, as particularly shown in FIG. 1, and adapted to engage against the floor as shown in FIG. 4. When the door seal assembly is connected to a door, so that the spring mechanism assemblies 5 and 6 are activated, as indicated in FIGS. 1 and 4, the leaf springs impart a downward pressure on the rails 1 and 2, which impart a downward pressure on the strips of soft sealing material 8 and 8″ to engage it against the floor to the firmness desired.

Once one of the two rails which constitute the compound body of the door seal has been connected on the door, such as connecting rail 1 on the door by connecting the body portion of spring mechanism assembly 6 to the door at the predetermined proper height above the floor, the other rail 2 is laterally slid out of rail 1 to the length necessary to cover the width of the door and the lower edge of the door, and the rails are locked together by screw 7. The body portion of spring mechanism assembly 5 is then moved in the direction of the arrow shown adjacent that body portion in FIG. 4, until the soft sealing material 8, 8″ engages the floor to the firmness desired, and that body portion is then fastened to the door by fasteners extending through the slots shown, to thus also fasten the rail 2 to the lower portion of the door, thus sealing the opening between the floor and the lower edge of the door.

It is understood, that in this case details of construction and finishing can be varied that do not alter, change or modify the essential structural elements of the invention.

I claim:

1. A seal rail for the lower edge of doors or panels comprising, at least two juxtaposed longitudinally extending rails, an interengaging longitudinal sliding connection means between said two rails permitting longitudinal extension of said rails to a length conforming to the width of a door or panel, means for fastening said two rails to a door or panel such that once fastened to a door or panel the vertical height of said rails can be adjusted so as to act as a seal for a gap under a door or panel, and releasable lock means connected to one of said rails and extending into contact with the other of said two rails, said releasable lock means having a release position in which said releasable lock means is not in contact with the other of said two rails permitting longitudinal extension of said two rails one to the other to a desired extended length once the two rails are fastened to a door or panel by said fastening means, and said releasable lock means having a locked position in which said releasable lock means is in contact with the other of said two rails fastening them one to the other in a desired extended length.

2. A seal rail for the lower edge of doors or panels as set forth in claim 1, in which said means for fastening said two rails to a door or panel comprise a pair of spring mechanism assemblies, said two rails having upper surface portions, each spring mechanism assembly connected to the upper surface portion of a respective rail of said two rails, each spring mechanism assembly having a body portion connectable to a door or panel independently of the other, whereby each spring mechanism assembly is connected to a respective rail of said two rails in all adjusted lengths of said seal rail.

3. A seal rail for the lower edge of doors or panels comprising, at least two juxtaposed longitudinally extending rails, an interengaging longitudinal sliding connection means between said two rails permitting longitudinal extension of said rails to a length conforming to the width of a door or panel, means for fastening said two rails to a door or panel such that once fastened to a door or panel the vertical height of said rails can be adjusted so as to act as a seal for a gap under a door or panel, and a lock screw threadably engaged in one of said two rails and extending into contact with the other of said two rails to fasten them one to the other in a desired extended length once the two rails are fastened to a door or panel by said fastening means.

* * * * *